United States Patent [19]

Hedrick

[11] 4,088,052

[45] May 9, 1978

[54] STRING INSTRUMENT TUNING APPARATUS

[76] Inventor: W. David Hedrick, P.O. Box 39, Campbellsville, Ky. 42718

[21] Appl. No.: 738,120

[22] Filed: Nov. 2, 1976

[51] Int. Cl.[2] ..... G10G 7/02

[52] U.S. Cl. ..... 84/454; 84/459

[58] Field of Search ..... 84/454–460

[56] References Cited

U.S. PATENT DOCUMENTS

| | | | |
|---|---|---|---|
| 3,631,756 | 1/1972 | Mackworth-Young | 84/454 |
| 3,813,983 | 6/1974 | Paul | 84/454 X |
| 4,023,462 | 5/1977 | Denou et al. | 84/454 |

*Primary Examiner*—Lawrence R. Franklin
*Attorney, Agent, or Firm*—Robert D. Farkas

[57] ABSTRACT

This disclosure pertains to an apparatus utilized to detect the pitch in a string instrument, comparing it with a known standard, and providing an output error signal to an audio amplifier which drives a motor and gear train. The output shaft of the gear train is removably attached to the string tensioning pin. A timer activates the correcting motor in short bursts facilitating the manual striking of the string so as to produce a tone that may be measured. When the motor successfully adjusts the pitch produced by the string, the error signal is reduced sufficiently to prevent further motorized adjustments of the string tension. A meter is provided to indicate the relative pitch produced by the string by displaying the amplitude of the error signal. Locking means prevents the output shaft from being rotated by the motor, thereby enabling the user to manually adjust the pin when desired.

10 Claims, 4 Drawing Figures

STRING INSTRUMENT TUNING APPARATUS

BACKGROUND OF THE INVENTION

1. The Field of the Invention

This invention relates to tuning apparatus and more particularly to that class which automatically adjusts the pitch of the instrument to be tuned in accordance with a set of provided frequency standards.

2. Description of the Prior Art

The prior art abounds with apparatus utilized in tuning musical instruments. U.S. Pat. No. 2,761,994 issued on Sept. 1, 1956 to J. W. Quitmeyer teaches a stroboscopic disc utilized as a frequency standard and providing indicia means which indicates the correct tuning of any note in the chromatic tempered scale of notes, employing a microphone which receives the sound of the played note which is then compared to the standard pitch by illuminating a lamp casting light upon the disc.

U.S. Pat. No. 3,509,454 issued on Apr. 28, 1970 to D. Gossel discloses an apparatus for tuning musical instruments in which the output of a variable frequency generator is compared with a signal adduced from the musical instrument by utilizing a digital divider to produce two frequencies, differing by one musical half-tone. After comparison in a phase sensitive comparator, the frequency differences are optically displayed.

U.S. Pat. No. 3,631,756 issued on Jan. 4, 1972 to R. C. Mackworth-Young pertains to an apparatus for tuning a musical instrument comprising a generator of electric oscillations of reference frequency including an array of tuning forks which can be brought, in succession, into register with a driving coil for maintaining the adjacent tuning fork in oscillation. A pick-up coil provides a signal dependent on vibrations of the said tuning fork. The signal is amplified by an amplifier and fed on the one hand to the driving coil and on the other hand to a frequency comparator with a "magic Eye". A microphone, for picking up oscillations from a vibratory element of the musical instrument to be tuned, is connected through an amplifier to the frequency comparator.

All of the aforementioned patents suffer the common deficiency of requiring manual trial and error techniques to obtain the proper output pitch from the instrument to be tuned, even though the need to use one's ability to audibly compare the pitch from a frequency standard, such as a tuning fork, to the pitch produced by the musical instrument, the utility of such devices are limited for use by operating personnel possessing the manual dexterity and patience to adjust the pitch of the musical instrument upwards and downwards until the visual indicator provides him with information that the correct pitch has been achieved.

SUMMARY OF THE INVENTION

A primary object of the present invention is to provide a musical tuning instrument which automatically adjusts the output pitch of the instrument to a correct frequency.

Another object of the present invention is to provide an apparatus which visually indicates the pitch of the musical instrument relative to a known frequency standard.

Still another object of the present invention is to provide a motorized pitch adjusting apparatus which operates in intermittent time intervals allowing the operator thereof to produce successive tones from the musical instrument to be tuned.

Yet another object of the present invention is to provide a musical instrument tuning apparatus which can be used manually, in the customary fashion, without the automatic motorized pitch adjusting components thereof in use.

Heretofore, musical instrument tuning devices provided various forms of visual displays which informed the user thereof, of the relative pitch between the standard pitch generator provided therewith and the pitch produced by the musical instrument. Such apparatus provided a giant stride over the prior method requiring a musically talented individual to audibly compare the tones produced by the instrument with the tones produced by a tuning fork, at periods of time intermediate an adjustment to the musical instrument, altering the pitch of the tones produced thereby. Overshoot or overcompensation often resulted in repeated unnecessary adjustments with attendant wear and tear on the string tensioning device.

The present invention eliminates these problems by providing an apparatus which compares the musical instrument tone with a known standard and utilizes an output signal produced by the comparison thereof to rotate the string tensioning pin in step-wise fashion until the point is reached that the string is tensioned so as to produce a matched tone resulting in the disappearance of the error signal. The apparatus includes a meter indicating the direction and degree of deviation of the measured tone from the standard tone enabling the user to manually adjust the instrument downwardly in pitch so as to permit the apparatus to perform the tuning operation by driving the pitch of the musical instrument higher until the proper pitch is obtained. Since the apparatus does not adjust the pitch of the instrument in a lower direction as well as in an upward direction, hunting and jitter is eliminated.

These objects, as well as other objects of the present invention, will become more readily apparent after reading the following description of the accompanying drawings.

DESCRIPTION OF THE PREFERRED EMBODIMENT

Figure 1:
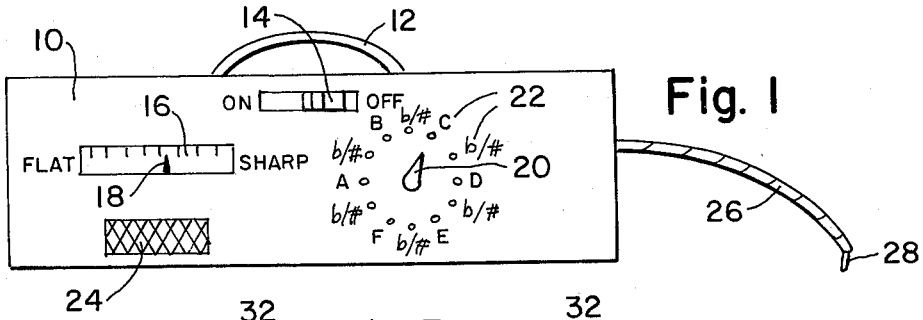
FIG. 1 is a front elevation view of a housing containing the electrical components of the instant invention.

The structure and method of fabrication of the present invention is applicable to a housing containing a meter, an on-off switch, a microphone, and a pitch selector switch secured to an outermost surface thereof. A flexible housing, encasing a flexible shaft therein, communicates a rotational motive power source located within the housing to a hand-held tuning instrument having a receptacle portion rotated by the flexible shaft. The hand-held tuning instrument is provided with a flanged locking screw, which when manually tightened, prevents the pin receiving receptacle portion from being operated by the motor, thus allowing the tuning apparatus to be operated manually, utilizing conventional tuning methods.

The microphone upon picking up the tone produced by one string of a musical instrument, such as a piano, provides an output signal which is suitably amplified, utilizing an audio amplifier therefor. The audio amplifier is located within the housing. Also contained within the housing is a plurality of fixed frequency signal generators, such as electrically energized tuning forks, crystal controlled oscillators and dividers and the like. The selector switch enables the user to select any pitch in one scale of a chromatic scale.

The output voltages produced by the selected frequency standard generator and the output of the audio amplifier are fed into a comparator circuit, whose voltage output increases as a function of the frequency difference between the two input voltages provided thereto. A bi-directional meter signals the differential in the input frequencies and is calibrated with a non-numerical scale, marked "sharp" at one end and "flat" at the other.

The output signal of the comparator, is an error signal that diminishes as the frequency difference between its output voltages decreases. The error signal is supplied to the input terminals of a direct current amplifier having a pitch adjusting motor at its output terminals. The output shaft of the motor is coupled to a gear train and thence to the pin receiving receptacle on the hand-held tuning apparatus. Also included within the housing is a timing apparatus, of the mechanical variety, utilizing a cam which intermittently closes switch contacts, controlling the period of possible energization of the tuning motor. The tuning motor becomes functional at periodic intervals, approximately two seconds apart, providing for time spans during which the string to be tuned may be struck or plucked by the operator.

In use, the operator causes the string to be tuned to produce a tone. The meter provides the operator with information concerning the pitch of the tone relative to the pitch of the frequency standard selected. Utilizing the tuning apparatus manually, the pitch of the string is set to a frequency lower than the pitch of the standard. In most string instruments, this step will be unnecessary, as is well known, strings tend to flat rather than sharp when out of tune. By setting or insuring that the string produced tone is at a lower pitch than the selected frequency standard, the pitch adjusting motor is permitted to operate in one direction, causing the string produced tone to raise in frequency as the string tension is increased. The error signal, diminishing as the pitch differential diminishes, ceases to cause the pitch adjusting motor to operate, during an allowed operating interval, when the frequency differential is reduced to zero, thereby automatically terminating the pitch increasing process. A glance at the meter, now nulled in the center regions, serves to verify that the string has been properly tensioned and is in tune.

Now referring to the Figures, and more particularly to the embodiment illustrated in FIG. 1 showing a housing 10 and having a handle 12 affixed thereto. On-off switch lever 14 controls the energization of the electronic components contained within the housing from power provided by a power supply, such as batteries, similarly contained within the housing. Meter 16 is provided with a movable pointer 18 and provides the user with visual information concerning the frequency of measured audible tones relative to the pitch of frequency standard generating tone apparatus contained within the housing. The frequency desired of the range of standard frequencies available from the set of frequency standards, is selected by rotating knob 20 to a position denoted by scale 22, divided into a chromatic scale having sharps and flats as well as natural tones. Knob 20 may be rotated in either direction and unlimitedly, facilitating rapid selection of a desired frequency standard. Microphone 24 picks up the audible tone produced by the musical instrument to be tuned. Flexible housing 26 covers flexible shaft 28, operated by a motor, not shown located within housing 10.

Figure 2:
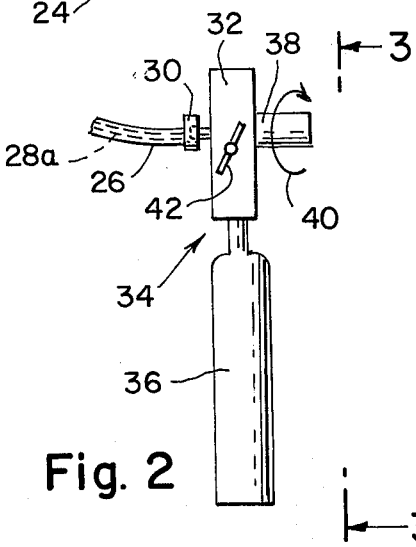
FIG. 2 is a side elevation view of the hand-held tuning apparatus forming part of the instant invention.

FIG. 2 illustrates flexible sheath 26 and flexible shaft **28*a*, shown in dotted lines, disposed within sheath 26. Coupling 30 connects shaft 28*a* to a gear train, not shown, contained within enclosure 32 of hand-held tuning apparatus 34. Handle 36, preferably made of wood, permits the user to rotate pin receiving housing 38 in the direction of arrows 40 when flanged set screw 42 is tightened, preventing shaft 28*a* from rotating pin receiving housing 38 and when the free end of handle 36 is rotated in the direction of arrow 40. When flange set screw 42 is loosened, shaft 28*a*, operating through the gear train, not shown, causes pin receiving housing 38** to rotate.

Figure 3:
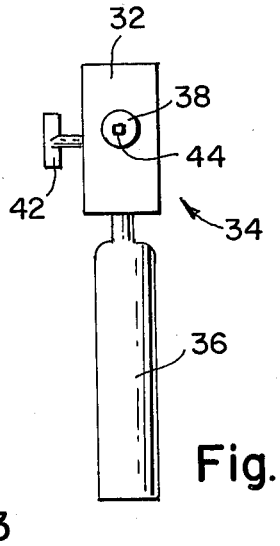
FIG. 3 is a front elevation view of the hand-held apparatus as viewed in the direction of arrows 3—3, as shown in FIG. 2.

FIG. 3 illustrates flange set screw 42 and pin receiving housing 38 extending outwardly from enclosure 32. Square opening 44 accommodates the string tensioning pin of the type normally found on pianos.

Figure 4:
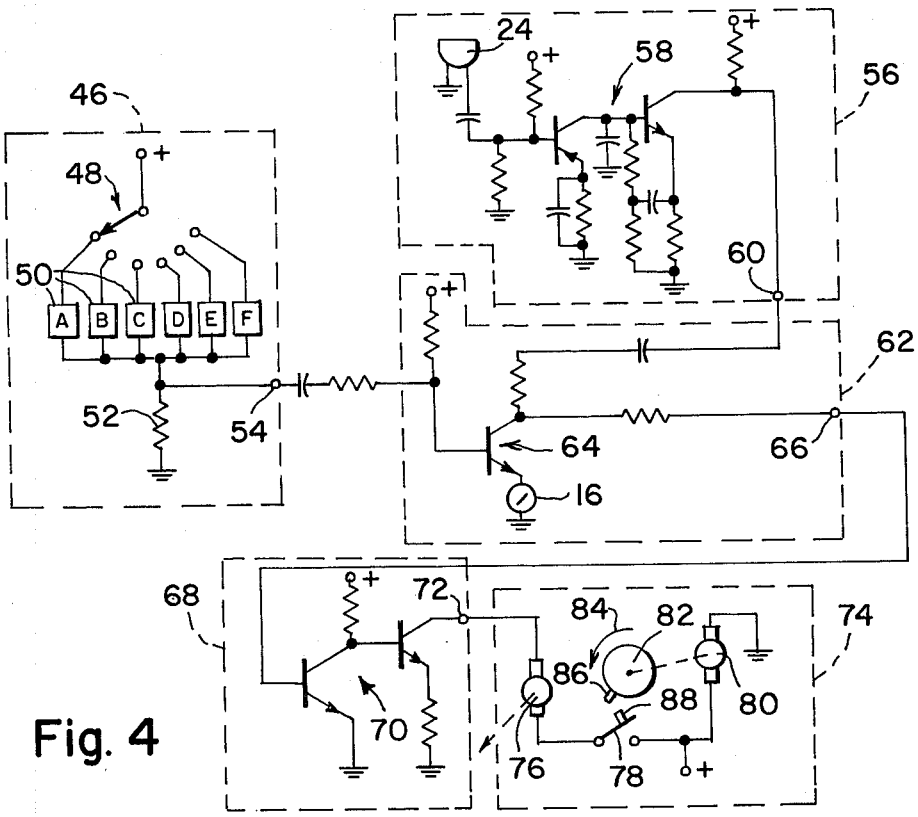
FIG. 4 is a schematic diagram of the electrical components of the instant invention.

FIG. 4 illustrates dotted lines 46 shown enclosing a selector switch 48 and a plurality of separate voltage generating sources whose frequency comprise the tones of the chromatic scale denoted by numeral 22 as shown in FIG. 1. Resistor 52 is disposed in the output circuits of each of the generators so as to produce a voltage at point 54 derived from a selected frequency standard generating device 50.

Dotted lines 56 confine microphone 24 and a solid state audio amplifier 58. Point 60 is provided with an alternating current voltage whose frequency is determined by the audible tones detected by mircophone 24 and produced by a struck string of the musical instrument to be tuned.

Dotted lines 62 enclose an NPN transistor 64, connected to act as a comparator for the voltage present at points 54 and 60. Meter 16 measures the relative frequencies of the incoming voltages to the comparator circuit. The voltage at point 66 represents the error signal, reducing to zero potential when the voltages at points 54 and 60 approximate the same frequency.

Dotted lines 68 contain therewithin a direct current voltage amplifier 70, producing at point 72 an output signal, representing an amplifier error signal available at point 66. Dotted lines 74 circumscribe tuning motor 76 shown having the terminals thereof in series with switch 78. Tuning motor 80 rotates cam 82 in the direction of arrow 84 so that protrusion 86 periodically engages operating lever 88 of switch 78. Thus, tuning motor 76 is energized intermittently and for short periods of time, determined by the width of protrusion which controls the closure of switch 78.

One of the advantages of the present invention is a musical tuning instrument which automatically adjusts the output pitch of the instrument to a correct frequency.

Another advantage of the present invention is an apparatus which visually indicates the pitch of the musical instrument relative to a known frequency standard.

Still another advantage of the present invention is a motorized pitch adjusting apparatus which operates in intermittent time intervals allowing the operator thereof to produce successive tones from the musical instrument to be tuned.

Yet another advantage of the present invention is a musical instrument tuning apparatus which can be used manually, in the customary fashion, without the automatic motorized pitch adjusting components thereof in use.

Thus, there is disclosed in the above description and in the drawings, an embodiment of the invention which fully and effectively accomplishes the objects thereof. However, it will become apparent to those skilled in the art, how to make variations and modifications to the instant invention.

Therefore, this invention is to be limited, not by the specific disclosure herein, but only by the appended claims.

I claim:

1. A string instrument tuning apparatus comprising a handheld tuning apparatus, a musical string instrument, string tensioning pin receiving receptacle, said pin receiving receptacle rotatably journalled to said tuning apparatus, a motor, said motor for rotating said pin receiving receptacle, audible detection means for receiving tones produced by said musical string instrument, voltage generating means for selectively producing one of a plurality of standard frequency voltages, selector switch means for separately electrically selecting said one of said plurality of standard frequency voltages, comparator means for providing an error signal voltage whose amplitude is proportioned to the difference in frequency of said tones and said one of said plurality of standard frequency voltages, motor energizing means for energizing said motor from said error signal voltage, timing means for intermittently controlling the timed duration of energization of said motor.

2. The string instrument tuning apparatus as claimed in claim 1 further comprising a gear train, said gear train rotatably operable intermediate the output shaft of said motor and said pin receiving receptacle.

3. The string instrument tuning apparatus as claimed in claim 1 further comprising a flexible shaft, said flexible shaft rotatably coupling the output shaft of said motor and said pin receiving receptacle.

4. The string instrument tuning apparatus as claimed in claim 1 wherein said audible detection means comprises a microphone, an audio amplifier, said microphone being disposed adjacent said musical string instrument for the detection of said tones, said audio amplifier for the electrical amplification of said tones.

5. The string instrument tuning apparatus as claimed in claim 1 wherein said voltage generating means comprises a plurality of voltage producing audio oscillators, said plurality of voltage producing audio oscillators arranged to produce a chromatic musical scale.

6. The string instrument tuning apparatus as claimed in claim 5 wherein said selector switch means comprises a selector switch, said selector switch having terminals electrically connected to said plurality of voltage producing audio oscillators, an operating knob, said operating knob permitting the manual selection of each of said plurality of standard frequency voltages in repeated sequential order by the operation of said operating knob in one direction.

7. The string instrument tuning apparatus as claimed in claim 1 wherein said motor energizing means comprises a direct current amplifier whose input terminals are energized by said error signal voltage, the output terminals of said direct current amplifier providing operating power for said motor.

8. The string instrument tuning apparatus as claimed in claim 1 wherein said timing means comprises a timing motor, a cam, said cam rotatably affixed to the output shaft of said timing motor, a timing switch, a protrusion extending radially outwardly from said cam, said protrusion periodically operating said timing switch, the contacts of said timing switch controlling said timed duration of said energization of said motor.

9. The string instrument tuning apparatus as claimed in claim 1 further comprising a meter, said meter operated by said error signal voltage for indicating said amplitude.

10. The string instrument tuning apparatus as claimed in claim 1 further comprising locking means for preventing rotation of said pin receiving receptacle relative to said handheld tuning apparatus.

* * * * *